United States Patent [19]

Friend

[11] 4,039,394

[45] Aug. 2, 1977

[54] SLATTED TOP QUENCH CAR

[75] Inventor: Donald L. Friend, Allison Park, Pa.

[73] Assignee: United States Steel Corporation, Pittsburgh, Pa.

[21] Appl. No.: 664,774

[22] Filed: Mar. 8, 1976

[51] Int. Cl.[2] ..... C10B 39/08; C10B 39/14; C10B 45/00

[52] U.S. Cl. ..... 202/262; 202/227; 202/263

[58] Field of Search ..... 202/262, 263, 253, 227, 202/95; 13/33; 214/18 R, 18 PH; 201/39; 110/165, 171

[56] References Cited

U.S. PATENT DOCUMENTS

| | | | |
|---|---|---|---|
| 761,251 | 5/1904 | Price | 202/227 |
| 3,748,235 | 7/1973 | Pries | 202/227 |
| 3,806,032 | 4/1974 | Pries | 202/263 |
| 3,844,900 | 10/1974 | Schulte | 202/263 |
| 3,868,309 | 2/1975 | Sustarsic et al. | 202/262 |

FOREIGN PATENT DOCUMENTS

| | | | |
|---|---|---|---|
| 791,078 | 6/1935 | France | 202/253 |
| 429,990 | 1/1911 | France | 202/262 |

*Primary Examiner*—Barry S. Richman
*Assistant Examiner*—Bradley Garris
*Attorney, Agent, or Firm*—William L. Krayer

[57] ABSTRACT

A car for receiving, transporting and quenching incandescent coke includes a series of normally closed slats covering the top of the car; they are adapted to open at the coke guide to receive coke. A stationary cam located on or near the coke guide may actuate levers as the car moves, to open the slats directly in front of the coke guide; as the car moves further along, the cam releases the levers and the slats close to minimize pollution of the air from coke combustion. The slats are also opened by a cam track in the quench tower.

25 Claims, 7 Drawing Figures

SLATTED TOP QUENCH CAR

BACKGROUND OF THE INVENTION

Prior to the present invention, it had been common practice in coke making to transport incandescent coke from the oven to the quench tower in an open top quench car.

This practice is subject to criticism because between the pushed oven and the quench tower the combustion of coke in the car causes considerable pollution of the air.

SUMMARY OF THE INVENTION

My invention renders it possible to maintain the quench car in a covered state, in a simple and economical manner, except when the coke enters it and when the coke is quenched. My slatted-top quench car has a series of slats, preferably counterweighted, that cover the top of the quench car. These slats are normally closed except at the coke guide and the quench tower. At the coke guide the slats are tripped open preferably by a cam track mounted to or near the coke guide. When the slatted top quench car moves past the coke guide during a push the slats are tripped open to permit the coke to enter the quench car; once the car goes past the mouth of the coke guide the slats close, providing a continuous cover for the quench car during its travel to the quench tower. At the quench tower preferably a satisfactory cam or track opens the slats so that effective quenching can take place. The slatted top quench car minimizes air pollution since the coke is not exposed to the atmosphere while the quench car transports the hot coke from the oven just pushed to the quench tower. The portion of the quench car which is already filled with hot coke is also covered while the rest of the car is filled.

The slatted top quench car can be used in conjunction with a canopy or shroud at the coke guide and/or with a companion scrubber car, to achieve a very effective emissions collection system.

My invention will be further described with reference to the attached drawings.

Figure 1:
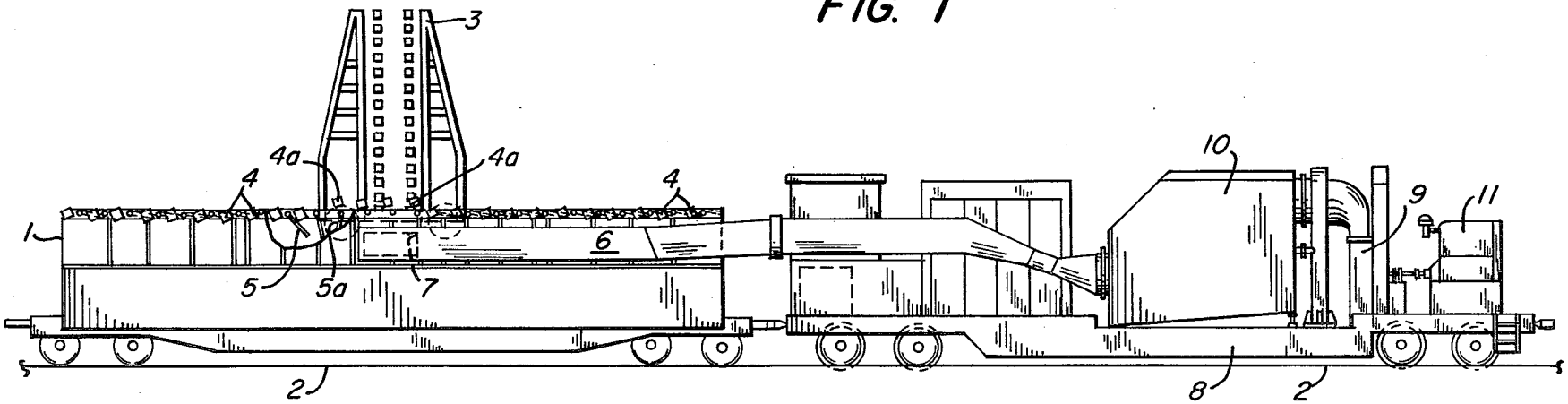
FIG. 1 is a side elevational view of my quench car showing the quench car in position by the coke guide and followed by a scrubber car.

Referring now to FIG. 1, quench car 1 is shown in position on rail 2 passing in front of coke guide 3. The function of the coke guide 3, as is known in the art, is to guide the hot, incandescent coke in its path from the coke oven from which it is pushed into the quench car. A plurality of counterweights 4 are visible on the near side of quench car 1. The counterweights 4 are attached to slats 5, or to levers 4B attached to slats 5, in a manner so as to normally counterbalance the slats 5 in a closed, i.e. horizontal position. The counterweights 4A which are in a raised position indicate that the corresponding slats 5A are open.

Along the side of quench car 1 may be placed a duct 6 having occasional access through openings 7 to the interior of the quench car 1. The duct 6 is connected to an integral scrubbing car 8 which carries a suction fan 9 and a gas scrubbing vessel 10 which contains means (not shown) for spraying the gas and air in a conventional manner to remove contaminants. A pump 11 is placed on scrubbing car 8 to circulate the required water or other liquid through the scrubbing vessel 10.

Figure 2:
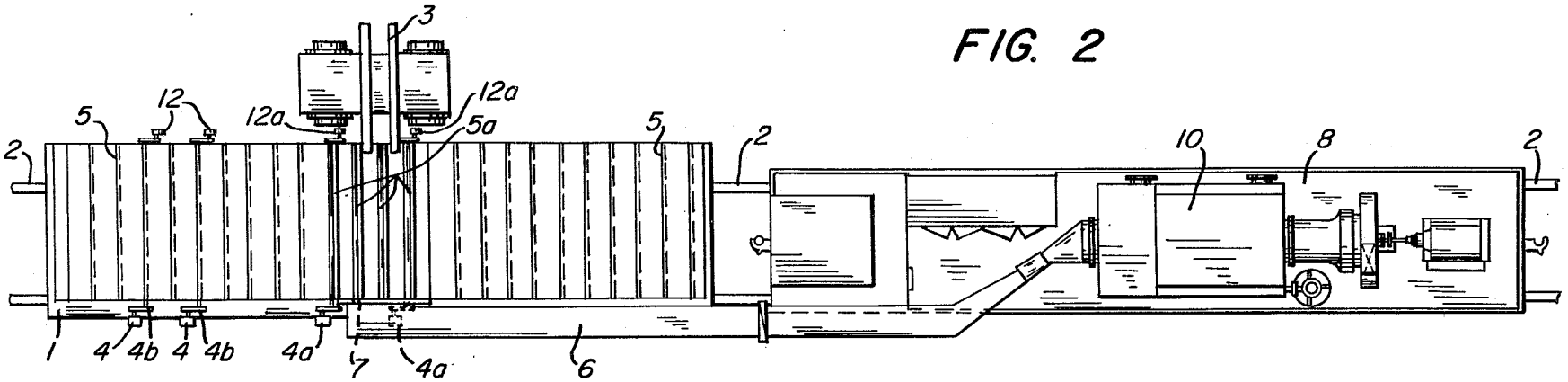
FIG. 2 is an overhead view of the quench and scrubbing cars showing the slats open in front of the coke guide.

Referring now to FIG. 2, the overhead view shows quench car 1 and scrubbing car 8 on rails 2, with quench car 1 passing by the coke guide 3. The slats 5A in front of coke guide 3 are in the open (vertical) position; all other slats 5 are in the closed (horizontal) position to retain the fumes and products of combustion within the quench car 1. Counterweights 4 and 4A are shown on the side of the quench car away from the coke guide 3; cam followers 12 and 12A are shown on the coke guide side in normal and tripped positions respectively.

Figure 3:
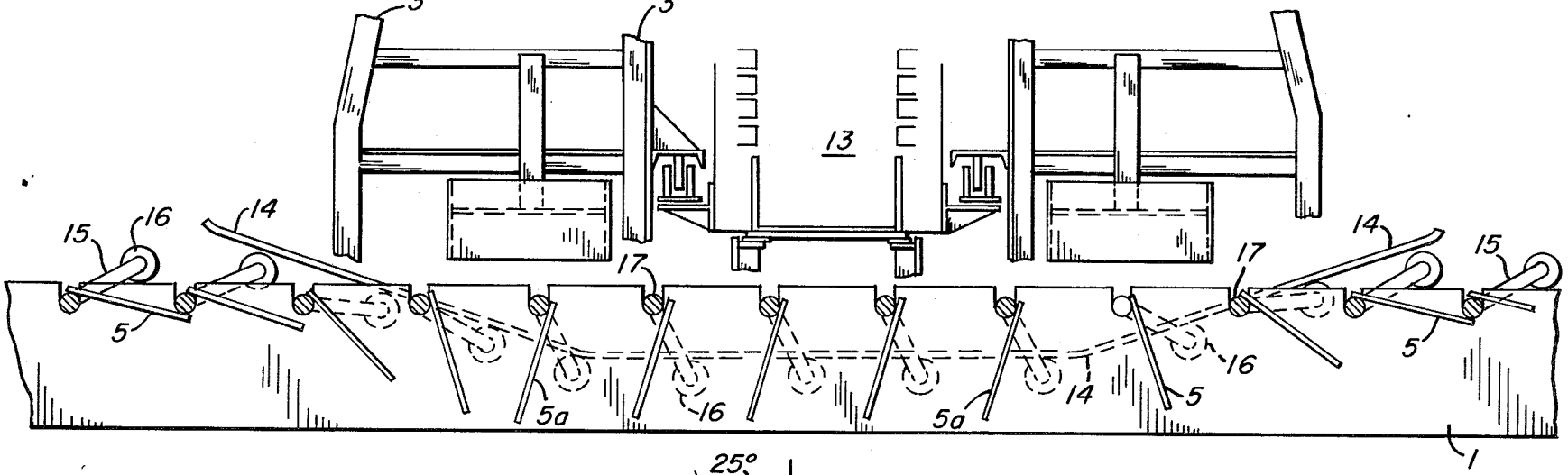
FIG. 3 is a detailed side view of the operation of the coke guide cam to open the slats to receive the coke.

In FIG. 3, slats 5 are seen in various positions of movement as the quench car 1 passes beside coke guide 3. Incandescent coke passes through opening or slot 13 directly downward between open or vertical slats 5A and into the interior of quench car 1. Positioned on coke guide 3 is a cam track 14 having slanted entry and exit portions and a generally horizontal portion directly in front of and below slot 13. Crank arms 15 having roller elements 16 (together making up cam followers 12) follow the cam track 14 as quench car 1 moves into position by coke guide 3. In following the cam track 14, crank arms 15 rotate about 80° to 90° so that the slats 5 move into a vertical position as at 5A, thus permitting the incandescent coke in slot 13 to fall between slats 5A and into quench car 1. It will be noted that in the depicted configuration, slats 5 rotate on or with bars 17, which transverse the top of the quench car 1.

Figure 4:
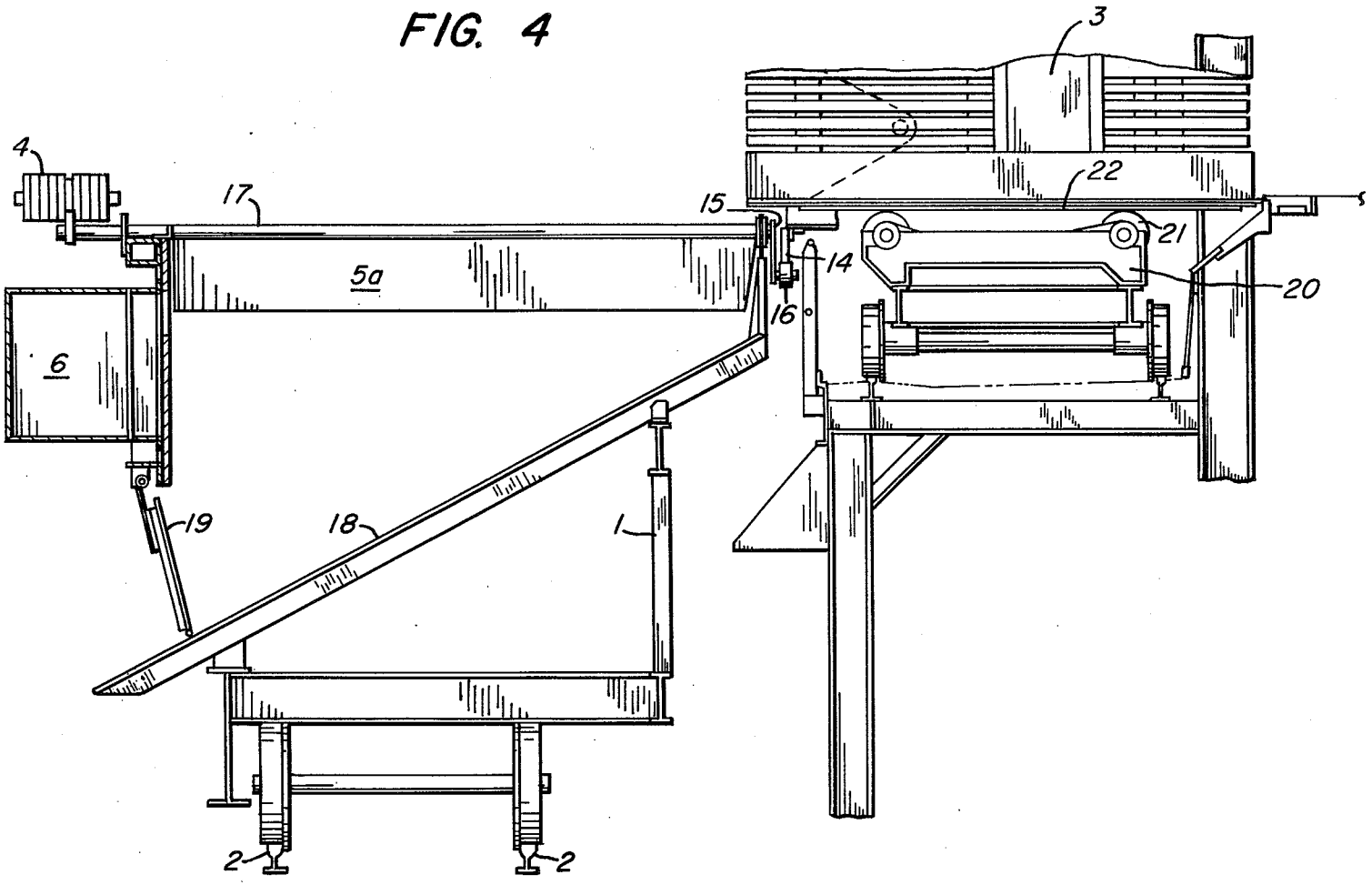
FIG. 4 depicts the quench car from its end and shows the relative positions of a slat, its counterweight and cam follower, and the coke guide car.

In FIG. 4, quench car 1 is seen from an end view showing the typically sloping floor 18, and dumping element 19, which may be opened in a conventional manner to release the quenched coke. Also seen from a different perspective are rails 2, duct 6, counterweight 4, roller element 16, slat 5A, bar 17, cam track 14, and coke guide 3. Coke guide 3 is typically mounted on a coke guide car 20 and may be positioned relative to the coke oven door (not shown) by wheels 21 and ways 22.

Figure 5:
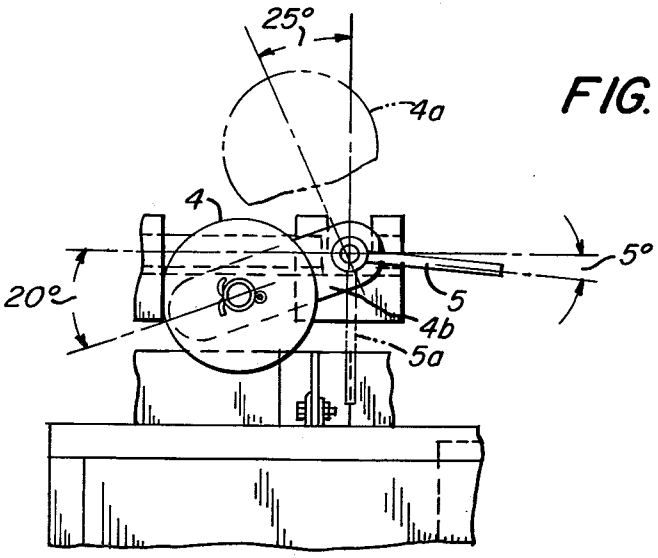
FIG. 5 shows the closed and open positions of the preferred counterweight configurations.

Referring to FIG. 5, the preferred angles for the most efficient counterweight movements are shown for counterweight 4. The designation 4A represents the position of the weight when slat 5A is in the vertical or open position; this angle is about 25° from the vertical. Since in my preferred configuration, the slats 5 contact the adjacent bars 17 when in the closed position and thus are about 5° off the horizontal, the slats 5 and their associated weights 4 need to rotate only about 85° . Thus, while the greatest lifting moment is provided by counterweight 4A at about 25° off the vertical, its position when the slat is closed is about 20° below horizontal.

Figure 6:
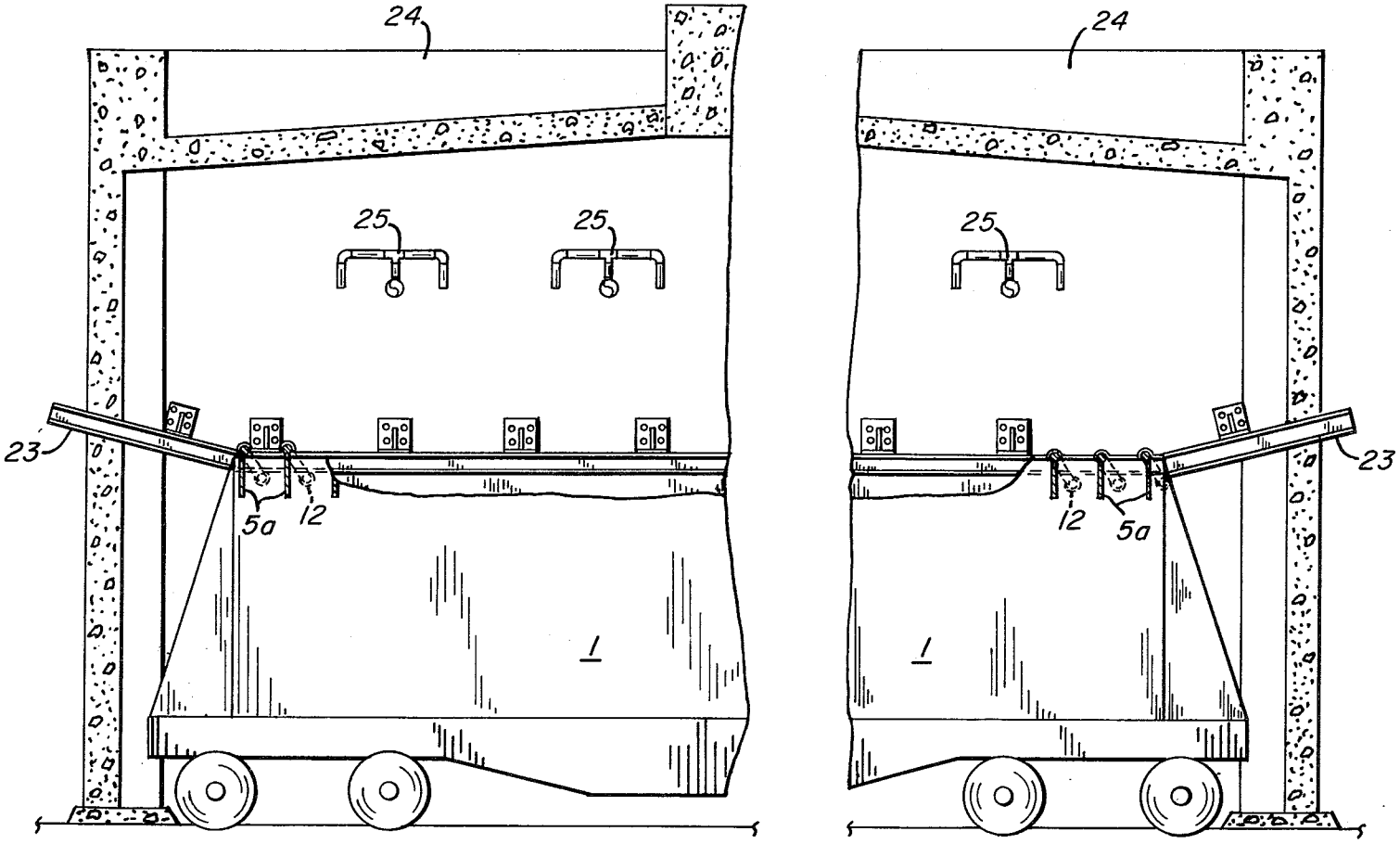
FIG. 6 illustrates from a side view the position of the slats when the quench car is in a quench tower.

In FIG. 6, a long stationary cam track 23 in a quench tower 24 trips and holds open all slats 5A through the action of cam followers 12 as with the coke guide. The slats are then held open during the quench operation as in the coke pushing step, except that in the quench tower they may all be open while quench water emanates from nozzles or pipes 25. As soon as quench car 1 is removed from the quench tower, the slats 5 resume their normally closed position.

Figure 7:
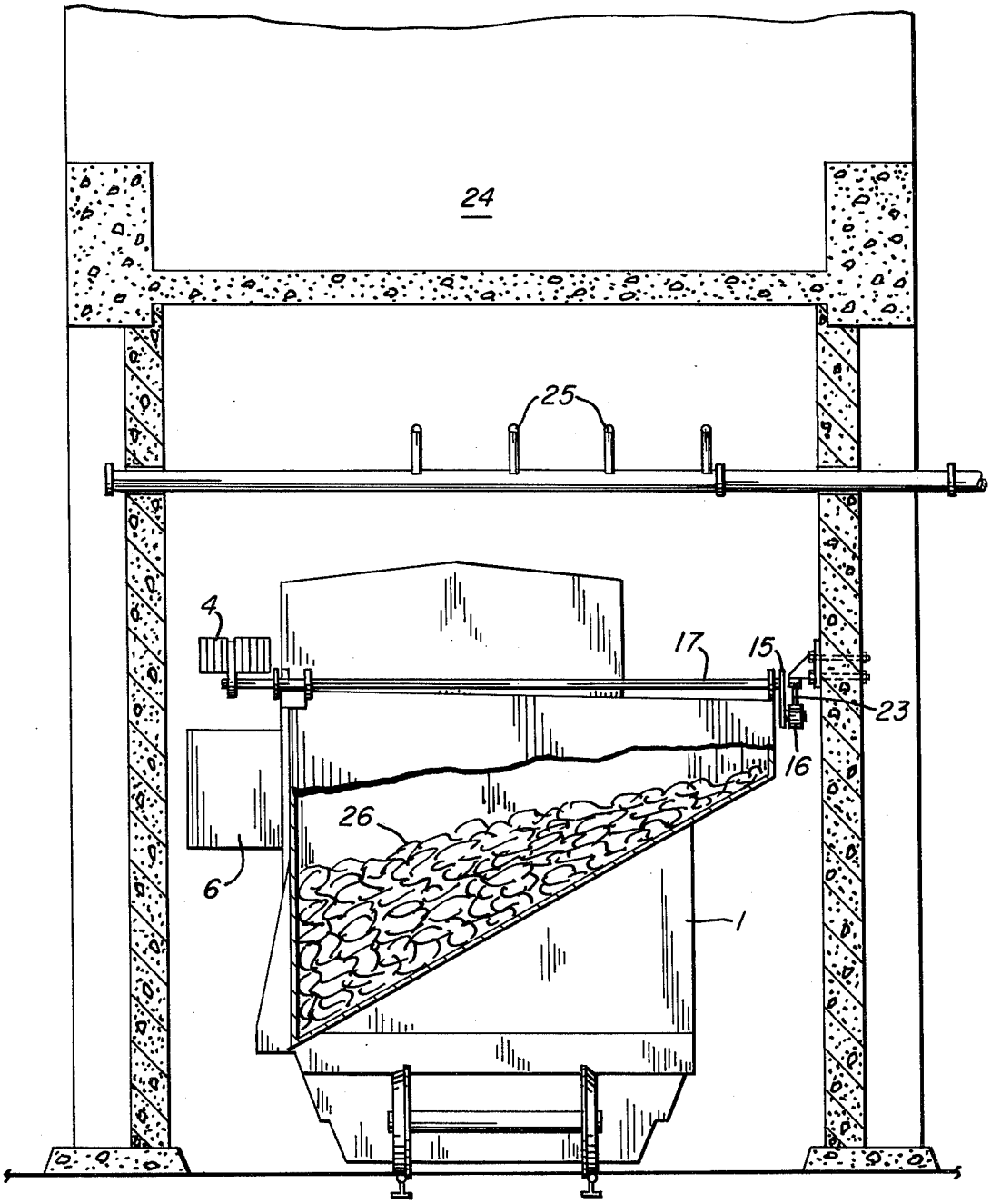
FIG. 7 is an end, partially sectioned, view of the quench car in a quench tower.

The end view in FIG. 7 of the quenching operation again shows quenching tower 24, quench pipes 25, bars 17, roller element 16, counterweight 4, cam track 23 and duct 6.

My invention may be varied in several respects, as for example the slats may be opened and closed by automatic controls such as electrical or pneumatic signals or actuators. However, because of the severe conditions created by the handling of incandescent coke, mechanical controls are preferred. The number of slats may vary, but will be limited by the desirability of avoiding striking the coke or parts of the quench car when opening or closing. The slats may have extensions on the sides opposite the rods, partly to counterbalance the main slat, which enables a more nearly horizontal closed position; however, this has the disadvantage that such extensions will bear in brunt of the falling coke, resulting in increased wear and tear on that portion of the slats. The counterweight may of course be positioned anywhere near the vertical when the slat is in the open position, i.e. from 35° to 0° off the vertical, but I prefer its open position between 20° and 30° because of the more efficient moment useful in moving the slat from the open vertical position to the closed almost-horizontal position. The crank arm 15 of the cam follower 12 should be preferably about 30° above the horizontal; moving 85° downward under the influence of the cam track, it will be positioned at about 55° below the horizontal when the slat is fully open. The entrance and exit slopes of cam tracks 14 and 23 are conveniently about 45° from the horizontal but may be any incline which does not impede the progress of the quench car or cause unnecessary impact damage.

I claim:

1. A covered quench car for receiving incandescent coke from a coke oven and transporting it to a quenching site for quenching comprising a. a quench car including walls for containing coke and an open top, and b. means for closing said open to top comprising:

i. a plurality of slats having substantially parallel edges transversing the top of said quench car, said slats having sufficient width to permit the opposing edges thereof to cooperate to form a closure which prevents the emission of fumes into the atmosphere above said car; and ii. means for opening at least some of said slats to permit coke to pass into said quench car from above and to close said slats after coke is received in said car.

2. The quench car of claim 1 wherein said slats are mounted on bars transversing the top thereof.

3. The quench car of claim 1 wherein said slats are counterbalanced with counterbalancing weights to maintain a normally closed position.

4. The quench car of claim 1 wherein said means for opening said slats includes a cam follower attached to each slat.

5. The quench car of claim 1 in combination with cam track means at the point of coke delivery to actuate said means for opening some of said slats.

6. The quench car of claim 1 in combination with cam track means at the point of quenching to actuate said means for opening said slats.

7. The quench car of claim 1 in combination with means operatively associated with said car for evacuating and purifying fumes emanating therefrom.

8. A pollution-controlled quench system for transporting incandescent coke from a coke oven to a quench tower comprising A. a quench car including:

a. a container element including a floor and walls;

b. a plurality of slats in normally closed position transversing said container element from side to side and forming a top enclosure;

c. lever means for rotating each of said slats on an axis extending across their respective lengths, and B. means adjacent to the coke oven and said quench tower for controlling the rotation of said slats from the normally closed position to a vertical, open position, and from the open position to the closed position by actuating said lever means.

9. The quench system of claim 8 wherein said slats are counterbalanced with counterweights to maintain them in a substantially horizontal, normally closed, position.

10. The quench system of claim 8 in which said lever means for rotating said slats includes cam followers and cranks attached to said slats.

11. The quench system of claim 10 in which said means for controlling the rotation of said slats includes a cam track for actuating the cam followers.

12. The combination of claim 11 wherein said cam track is located adjacent to a means for directing coke into said quench car.

13. The combination of claim 11 wherein said cam track is located at the quench tower.

14. In a quench car for receiving incandescent coke from a coke oven through a coke guide in front of said oven and transporting said coke to a quenching site for quenching while in said car;

the improvement comprising:

a. a top for said car for preventing the escape of fumes from said coke which comprises a plurality of independently operable parallel slats pivotally mounted to the top of said car on axes which are disposed transversely to the length of said car for movement from a substantially horizontal position wherein each slat is in contact with its adjacent slats along the edges thereof and said top is closed, to a substantially vertical wherein said top is open; and b. means for actuating said slats in response to movement of said car past said guide such that said slats are sequentially opened when said car passes under the mouth of said guide and thereafter sequentially closed as said car passes beyond said guide.

15. The quench car of claim 14 wherein the improvement further comprises counterbalance means for biasing said slats in closed position.

16. In a system for quenching coke which includes a coke oven containing coke, a coke guide positioned in front of said oven, a quench car for receiving said coke as it is pushed from said oven through said guide and transporting said coke to a quench site for quenching while in said car;

the improvement comprising:

a. a plurality of parallel slats pivotally mounted to the top of said car on axes substantially perpendicular to the length of said car forming a top enclosure for preventing the escape of fumes emanating from said coke, said slats movable from a closed position wherein said slats are substantially horizontal with the edges of one slat in contact with its adjacent slats along the edges thereof to an open position wherein said slats are substantially vertical; and b. means for actuating said slats in response to movement of said car past said guide such that said slats are sequentially opened as said car passes under the mouth of said guide and thereafter sequentially closed as said car passes beyond said guide.

17. The system of claim 16 wherein the improvement further comprises counterbalance means for biasing said slats in said closed position.

18. The system of claim 16 further comprising gas evacuation and scrubbing means operatively associated with said car for purifying said fumes.

19. The system of claim 16 wherein the improvement further comprises a second means for actuating said slats at said quenching site such that said slats are opened for quenching said coke.

20. The system of claim 19 wherein said second actuating means is a cam track located at said quenching site.

21. The system of claim 16 wherein said means for actuating said slats comprises:

a crank cam attached to one end of each slat and a cam follower attached to the end of said crank arm remote from said slat.

22. The system of claim 21 wherein said actuating means further comprises a cam track located on said coke guide that is shaped to open only those slats in front of said guide to allow the continuous passage of said coke into said car as it travels under the mouth of said guide.

23. In a quench car for receiving incandescent coke from a coke oven through a coke guide in front of said oven and transporting said coke to a quenching site for quenching while in said car, the improvement comprising:

a. a top for said car for preventing the escape of fumes from said coke which comprises a plurality of parallel slats pivotally mounted to the top of said car on axes which are disposed transversely to the length of said car for movement from a substantially horizontal position wherein each slat is in contact with its adjacent slats along the edges thereof and said top is closed, to a substantially vertical position wherein said top is open, and b. means for pivoting at least some of said slats to open and close said top.

24. The quench car of claim 23 wherein said means for opening and closing said slats includes a common linkage between said slats.

25. The quench car of claim 23 wherein said means for opening and closing said slats includes means for independently operating said slats in sequence.

* * * * *

UNITED STATES PATENT OFFICE

CERTIFICATE OF CORRECTION

Patent No. 4,039,394 Dated August 2, 1977

Inventor(s) Donald L. Friend

It is certified that error appears in the above-identified patent and that said Letters Patent are hereby corrected as shown below:

Column 1, line 30, change "satisfactory" to -- stationary --.

Column 3, line 44, after "open", delete "to".

Column 4, line 47, after "vertical", insert -- position --.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*